US006961988B2

(12) United States Patent
Koons

(10) Patent No.: US 6,961,988 B2
(45) Date of Patent: Nov. 8, 2005

(54) FREEZER DOOR ASSEMBLY

(75) Inventor: Bill J. Koons, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/898,622

(22) Filed: Jul. 26, 2004

(65) Prior Publication Data

US 2004/0256965 A1 Dec. 23, 2004

Related U.S. Application Data

(62) Division of application No. 10/379,802, filed on Mar. 6, 2003, now Pat. No. 6,779,859.

(60) Provisional application No. 60/364,104, filed on Mar. 15, 2002.

(51) Int. Cl.[7] ..... B23P 11/02

(52) U.S. Cl. ..... 29/525.11; 312/348.4; 49/501; 52/656.4; 52/657

(58) Field of Search ..... 29/525.01, 525.11, 29/525.13; 49/501, DIG. 1, DIG. 2; 312/405, 312/348.4; 52/656.4, 657

(56) References Cited

U.S. PATENT DOCUMENTS

| | | | | |
|---|---|---|---|---|
| 1,735,047 A | | 11/1929 | Knobloch | |
| 2,652,601 A | | 9/1953 | Slopa et al. | |
| 2,665,456 A | * | 1/1954 | Morton | 312/405 |
| 2,718,446 A | * | 9/1955 | Hinkel | 312/405.1 |
| 2,764,785 A | * | 10/1956 | Sulcek | 52/784.15 |
| 2,839,347 A | | 6/1958 | Strub | |
| 3,834,101 A | | 9/1974 | Wilder et al. | |
| 3,949,526 A | | 4/1976 | Sherlock et al. | |
| 4,087,143 A | | 5/1978 | Barnard et al. | |
| 4,127,347 A | * | 11/1978 | Pritchard | 52/657 |
| 4,196,952 A | * | 4/1980 | Crowe | 312/236 |
| 4,586,348 A | * | 5/1986 | Nakayama et al. | 52/656.4 |
| 4,606,112 A | | 8/1986 | Jenkins et al. | |
| 4,787,133 A | * | 11/1988 | Lesmeister et al. | 29/460 |
| 4,829,653 A | * | 5/1989 | Stich | 29/525.01 |
| 4,903,858 A | * | 2/1990 | Clark et al. | 220/592.02 |
| 4,958,890 A | * | 9/1990 | Anderson et al. | 312/406.2 |
| 5,040,856 A | | 8/1991 | Wilkins et al. | |
| 5,244,273 A | | 9/1993 | Kaspar et al. | |
| 5,306,082 A | | 4/1994 | Karlin et al. | |
| 5,312,078 A | | 5/1994 | Marsh | |
| 5,897,181 A | * | 4/1999 | Avendano et al. | 312/401 |
| 5,909,937 A | | 6/1999 | Jenkins et al. | |
| 5,924,259 A | | 7/1999 | Marousek | |
| 6,138,432 A | | 10/2000 | Banicevic | |
| 6,209,265 B1 | * | 4/2001 | Banicevic et al. | 49/501 |
| 6,505,442 B2 | * | 1/2003 | Banicevic et al. | 49/501 |
| 2003/0111943 A1 | | 6/2003 | Banicevic et al. | |
| 2004/0035129 A1 | | 2/2004 | Kaiser | |

FOREIGN PATENT DOCUMENTS

| | | |
|---|---|---|
| JP | 08230079 | 9/1996 |
| JP | 2000094479 | 4/2000 |

* cited by examiner

*Primary Examiner*—David P. Bryant
(74) *Attorney, Agent, or Firm*—Diederiks & Whitelaw, PLC

(57) ABSTRACT

A freezer door, adapted to be slidably attached to a refrigerator cabinet, includes a metal outer door pan defining an internal cavity, a plurality of plastic corner brackets positioned in the internal cavity, and an inner door liner attached to the outer door pan. A pair vertical support brackets, used to connect the freezer door to slide support members of the refrigerator cabinet, are attached to the outer door pan with mechanical fasteners extending through slots formed in the inner door liner and being secured to the corner brackets.

8 Claims, 2 Drawing Sheets

FREEZER DOOR ASSEMBLY

CROSS REFERENCE TO RELATED APPLICATION

This application represents a divisional application of U.S. patent application Ser. No. 10/379,802 filed Mar. 6, 2003 now U.S. Pat. No. 6,779,859 which claims the benefit of U.S. Provisional Application Ser. No. 60/364,104 filed Mar. 15, 2002.

BACKGROUND OF THE INVENTION

1. Field of the Invention

The present invention pertains to the art of refrigerators and, more particularly, to the construction of a freezer door of a refrigerator.

2. Discussion of the Prior Art

There exist various styles of refrigerators on the market. Most common are side-by-side, top mount, and bottom mount models. In a side-by-side model, fresh food and freezer compartments are arranged laterally adjacent one another. A top mount refrigerator includes an upper freezer compartment and a lower fresh food compartment. Finally, bottom mount models have the fresh food compartment located above the freezer compartment.

In bottom mount models, it is known to employ either pivoting freezer doors and freezer doors which slide between open and closed positions. In bottom mount refrigerators employing sliding doors, it is common to mount rail assemblies to opposing side walls of the freezer compartment through the use of mechanical fasteners, and then to interconnect extensible portions of the rail assemblies to the freezer door. In this manner, the freezer door can be supported for selective sliding movement towards and away from the refrigerator cabinet, and one or more baskets can be supported upon the rails for movement in conjunction with the door.

In any case, at least the supports for the basket(s) are connected to the door such that, as the door is slid relative to a cabinet of the refrigerator, the basket shifts into and out of the freezer compartment. Since the freezer door is typically made of sheet metal or other thin materials, the door must be structurally reinforced in order to enable the secure attachment of the supports. Although an entire, dedicated door construction could be provided for this purpose, it is considered advantageous, at least from an economic standpoint, to provide a freezer door assembly which will enable freezer door components, as well as core manufacturing techniques and machinery, intended for use in constructing a pivoting freezer door to only be modified or supplemented so as to be usable in forming a sliding refrigerator freezer door. Therefore, there exists a need in the art for a cost effective and efficient manner in which to form a structurally reinforced, slidably mounted refrigerator freezer door.

SUMMARY OF THE INVENTION

The present invention is directed to forming a structurally reinforced refrigerator freezer door, particularly for use as a slidably mounted freezer door in a bottom mount style refrigerator. In general, the freezer door of the invention includes an outer door pan, an inner, preferably thermoformed door liner, a plurality of corner blocks, and vertical support brackets. In accordance with the most preferred form of the invention, the outer door pan is formed by bending a piece of sheet metal in order to create in-turned top, bottom, and opposing side wall portions, which extend substantially perpendicular to a front panel portion, as well as return flange portions which extend substantially parallel to the front panel portion. The return flange portions define a plurality of tabs which are preferably provided with holes. The front panel is spaced from the return flange portions such that an interior cavity is defined by the door pan. Brackets are preferably secured, such as by welding, mechanical fasteners or the like, within the interior cavity at the junctures of the top/side and bottom/side wall portions to enhance the structural rigidity of the door pan.

The corner blocks are positioned at respective corner portions of the interior cavity and then foam insulation is injected into the interior cavity, thereby filling any voids and fixedly securing the corner blocks in position. Thereafter, the door liner is fitted over the insulated door and fixedly secured to the door pan, preferably through the use of mechanical fasteners which extend through a peripheral portion of the door liner, are received in respective ones of the tab holes, and are covered by a peripheral gasket carried by the liner. The corner blocks are preferably molded as plastic honeycomb structures. The liner is also provided with holes which align with boss portions of the corner blocks, thereby enabling mechanical fasteners to be used to connect the vertical support brackets, which are ultimately adapted to be attached to generally horizontally extending slide rails of an overall support rail assembly for the door, to the liner, with the fasteners being securely received in the corner blocks. A handle is also preferably attached to the door pan.

Various advantages are achieve in forming a freezer door in accordance with the present invention. For instance, the door pan and liner can actually be used in connection with forming a freezer door intended for either pivoting or sliding movement. Employing the additional corner blocks provides the added structural reinforcement need to support the weight of the door, as well as any associated loaded freezer basket, for sliding movement. By making the corner blocks out of plastic in accordance with the invention, a lower thermal conductivity versus a metal block is established and a thermal break is created, thereby minimizing the transmission of thermal energy through the door. This, in turn, reduces the potential for condensation to develop on the exterior of the door, as well as decreases the overall energy consumption of the refrigerator.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
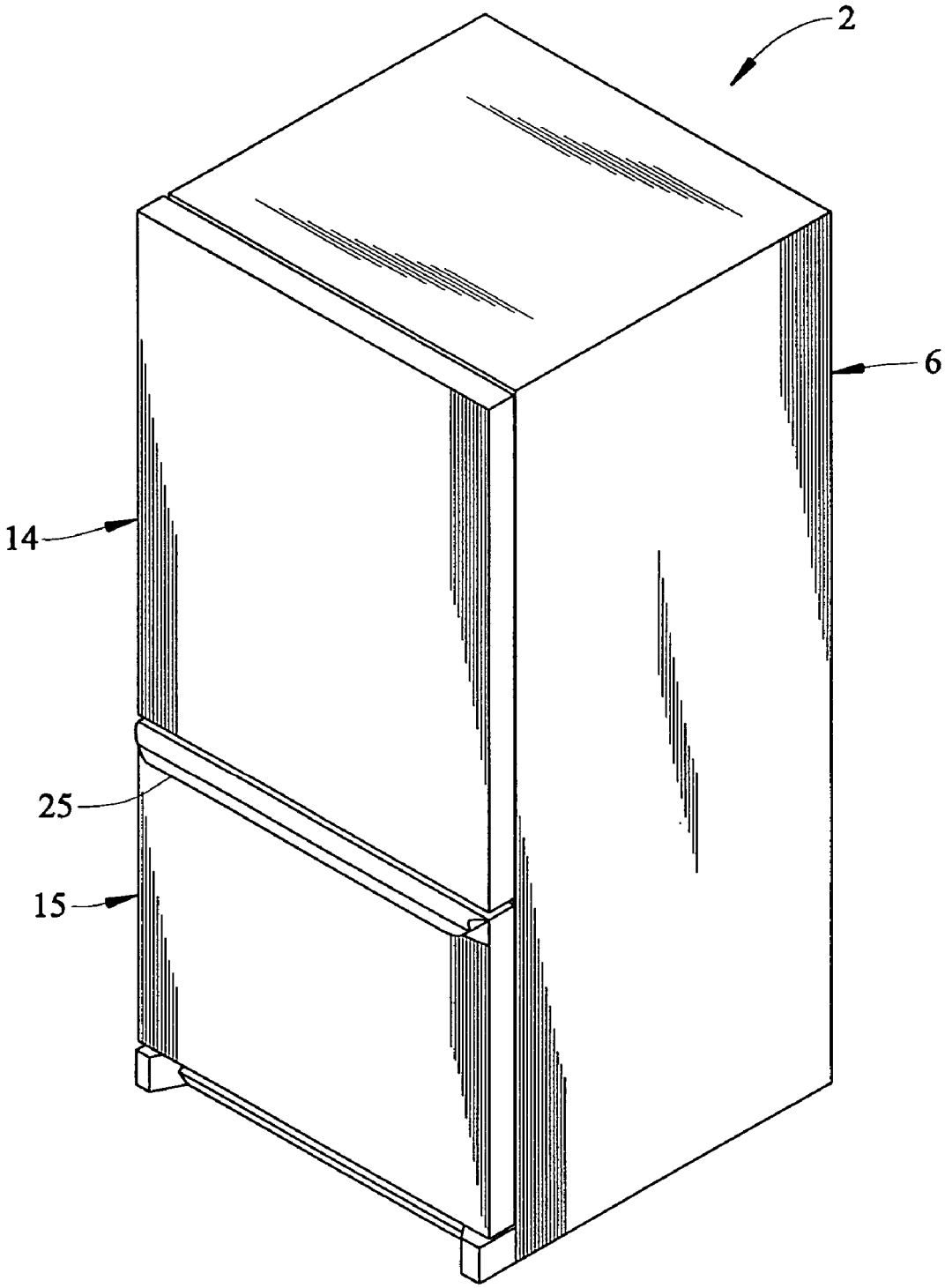
FIG. 1 is a perspective view of a bottom mount style refrigerator including a freezer door constructed in accordance with the present invention.

With initial reference to FIG. 1, a refrigerator incorporating the present invention as generally indicated at 2. As shown, refrigerator 2 includes a cabinet shell 6 provided with an upper fresh food compartment door 14 and a lower freezer compartment door 15. With this general construction, refrigerator 2 defines a bottom mount style unit. As is known in the art, fresh food door 14 is adapted to pivot about a vertical axis defined by upper and lower hinges (not shown) at a determined front side portion of cabinet shell 6. In addition, lower freezer door 15 is provided with a handle 25 for a shifting freezer door 15 relative to cabinet shell 6. In the most preferred form in the invention, lower freezer door 15 is adapted to slide relative to cabinet shell 6 between open and closed positions as will become more fully evident below.

Figure 2:
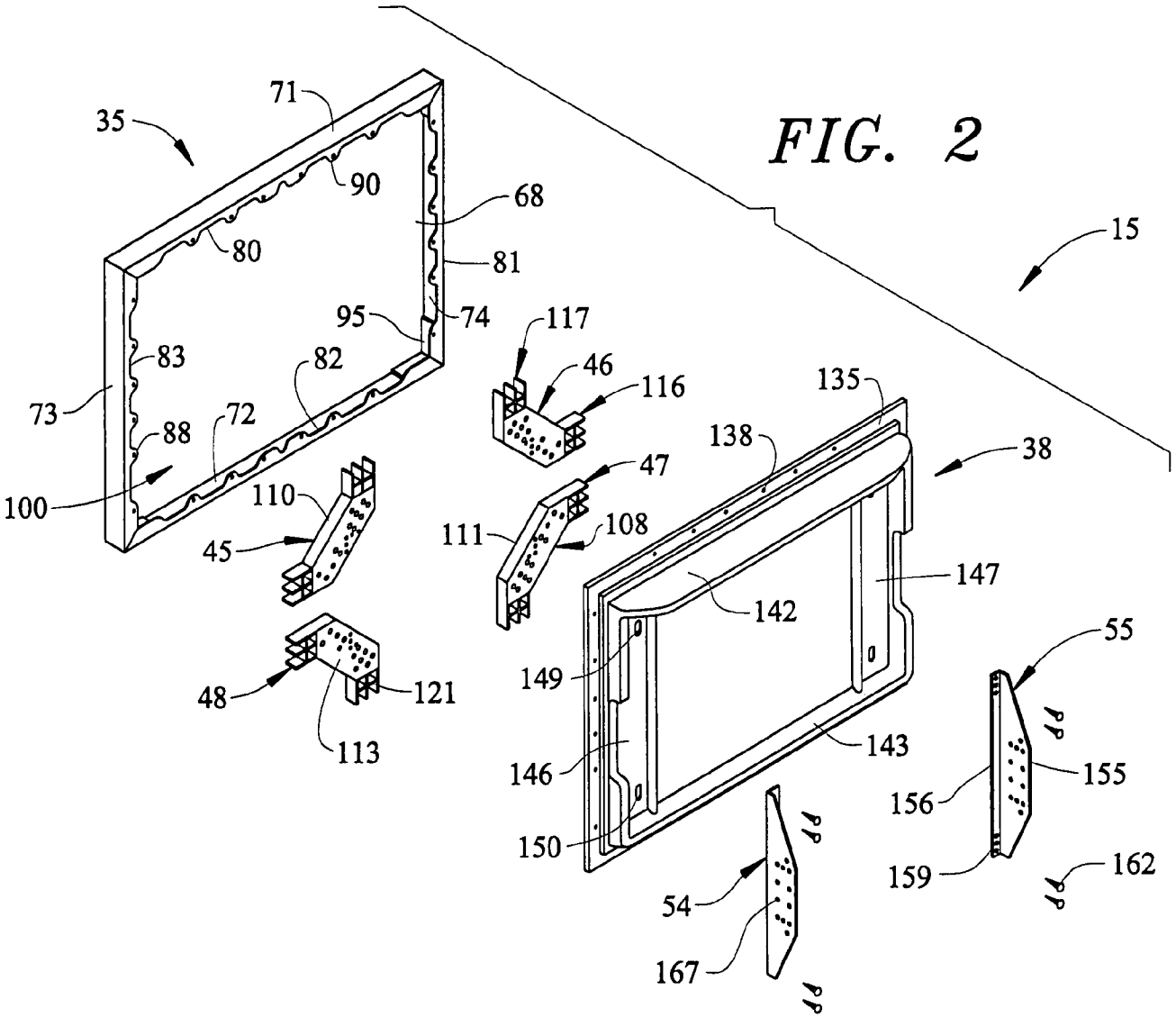
FIG. 2 is an exploded view of the freezer door assembly of the invention.

The present invention is particularly directed to the construction of freezer door 15 and reference will now be made to FIG. 2 in describing the components thereof. In general, freezer door 15 includes an outer door pan 35, and inner door liner 38, a plurality of corner blocks 45–48, and a pair of spaced vertical support brackets 54 and 55. In accordance with the most preferred form of the invention, outer door pan 35 is formed of sheet metal and includes a front panel portion 68. The sheet metal is bent so as to form top, bottom and opposing side wall portions 71–74 respectively. The piece of sheet metal is further bent to define a plurality of return flange portions 80–83. Preferably, each of top, bottom and side wall portions 71–74, as well as return flange portions 80–83 are trimmed or appropriately stamped at corners of door pan 35 such that top, bottom and side wall portions 71–74 extend substantially perpendicular to front panel portion 68 and return flange portions 80–83 are each spaced from and extend substantially parallel to front panel portion 68.

Each of return flange portions 80–83 are shown to include various tabs 88, each provided with a respective hole 90. To structurally reinforce the corners of outer door pan 35, generally L-shaped brackets, one of which is indicated at 95, are preferably, fixedly secured, such as by welding or the like, at the junctures of top wall portion 71 and each of side wall portions 73 and 74, as well as the junctions between bottom wall portion 72 and each of side wall portions 73 and 74. In essence, brackets 95 are arranged in interior cavity 100 of outer door pan 35, with interior cavity 100 being essentially defined between front panel portion 68 and return flange portions 80–83, within the confines of top, bottom and side wall portions 71–74.

Each corner block 45–48 is preferably molded of plastic and, most preferably, constitutes a honeycomb configured structure. As shown, each corner block 45–48 includes a central body portion 108 defined by a short side wall 110, a long side wall 111, and a face 113. Projecting from one end of central body portion 108 is a plurality of first wing elements 116 and projecting from another end of central body portion 108 is a second set of wing elements 117. As indicated in these figures and in accordance with the desired honeycomb structure, respective wing elements 116 and 117 are interconnected by cross members, such as that generally indicated at 121.

Inner door liner 38 is preferably thermoformed, but could also be injection molded, of plastic. In any event, inner door liner 38 preferably includes a peripheral portion 135 provided with various spaced holes 138 which are adapted to be aligned with holes 90 in return flange portions 80–83 of outer door pan 35 as will be discussed more fully below. In any event, although the specific configuration of inner door liner 38 can take various forms in accordance with the invention, inner door liner 38 is shown to include dike portions 142 and 143, as well as flat body portions 146 and 147. Each of flat body portions 146 and 147 is formed with at least one pair of spaced, preferably elongated apertures 149 and 150.

Vertical support brackets 54 and 55 are provided as part of the overall freezer door 15 in order to enable freezer door 15 to be readily attached to slide members that enable freezer door 15 to be shifted relative to cabinet shell 6. In general, providing a bottom mount style refrigerator with a slideable lower freezer door is known in the art. Therefore, it is simply important to recognize that an extendible and retractable slide assembly, used to interconnect freezer door 15 to a liner positioned within cabinet shell 6, is adapted to be fixedly secured to vertical support brackets 54 and 55. In accordance with the present invention, each vertical support bracket 54, 55 preferably includes a first leg 155 and an in-turned second leg 156. Each second leg 156 is preferably formed with spaced holes 159, while first leg 155 is provided with a plurality of transverse openings 167.

The overall assembly of freezer door 15 in accordance with the present invention will now be described. After assembling outer door pan 35 by bending the sheet metal to form front panel 68, top, bottom and side wall portions 71–74, and return flange portions 80–83 and, subsequently, securing brackets 95, outer door pan 35 takes the form shown in FIG. 2. At this point, outer door pan 35 is generally laid flat and corner brackets 45–48 are positioned such that the first and second sets of wing elements 116 and 117 abut respective ones of the top, bottom and side wall portions 71–74. For this purpose, as clearly depicted in this Figure, wing elements 116 generally extend substantially perpendicular to wing elements 117 in a manner directly corresponding to the relative positioning between top wall portion 71 and each of side wall portions 73 and 74, as well as bottom wall portion 72 with respect to side wall portions 73 and 74. Given the shape of central body portion 108 and the presence of short side 110, each corner block 45–48 can span a respective bracket 95 such that wing elements 116 and 117 can substantially, directly abut respective ones of top, bottom and side wall portions 71–74.

Once corner blocks 45–48 are respectfully positioned within internal cavity 100, internal cavity 100 is preferably injected with foamed insulation which fills internal cavity 100, thereby filling any voids associated with the honeycomb structure of corner blocks 45–48. After the foam insulation cures, corner blocks 45–48 are fixedly secured at desired positions within interior cavity 100 relative to outer door pan 35. Thereafter, inner door liner 38 is fitted over the insulated outer door pan 35 and fixedly secured to door pan 35, preferably through the use of mechanical fasteners, e.g. screws (not shown) which extend through respective aligned holes 138 and 90. Although not shown, an annular gasket is preferably provided around peripheral portion 135, with the gasket extending over and covering the screws used to secure door liner 38 to outer door pan 35. Therefore, in the manner known in the art, the gasket provides an aesthetic enhancement, while also establishing a seal adapted to engage cabinet shell 6 when freezer door 15 is closed.

As a final assembly step for freezer door 15, holes 159 in second leg 156 of each support bracket 54, 55 is aligned with a respective aperture 149, 150 provided in flat body portions 146 and 147. At this point, it should be realized that directly behind apertures 149 and 150 are located the central body portion 108 of a respective corner block 45–48. Screws, such as that indicated at 162, extend through holes 159, as well as apertures 149 and 150, and are threadably received within corner blocks 45–48. For this purpose, corner blocks 45–48 can actually be molded with bosses for specifically receiving screws 162.

This construction for freezer door 15 is seen to provide various enhancements. First of all, it is possible to form freezer door 15 in the manner set forth above to establish a structurally sound slideable freezer door for use in connection with refrigerator 2. However, outer door pan 35, and even inner door liner 38, can be correspondingly constructed, insulated and interconnected in a manner directly corresponding to that set forth above, without the use of corner blocks 45–48 or vertical support brackets 54 and 55, in order to construct a freezer door that can be mounted for pivotable movement about a vertical axis in another type of refrigerator. Therefore, door pan 35 and inner door liner 38 can actually be used in connection with forming a freezer door intended for either pivoting or sliding movement. Employing the additional corner blocks 45–48 provide the added structural reinforcement needed to support the weight of freezer door 15, as well as any associated freezer basket carried by the slides adapted to be secured to vertical support brackets 54 and 55. By making corner blocks 45–48 out of plastic in accordance with the invention, a lower thermal conductivity is established. Therefore, as opposed to perhaps utilizing a metal block, plastic corner blocks 45–48 will establish a thermal break within door pan 35, thereby minimizing the transmission of thermal energy through the overall freezer door 15. Of course, this in turn reduces the potential for condensation to develop on front panel portion 68, as well as enhances the overall energy efficiency of refrigerator 2.

In accordance with the most preferred embodiment of the invention, screws 162 extend freely through apertures 149 and 150 such that any forces exerted on vertical support brackets 54 and 55 are not directly exerted onto door liner 38. This is important as door liner 38 is actually made quite thin as is known in the art. Due to this mounting arrangement, the flexible nature of door liner 38 is not an issue in connection with the securing of support brackets 54 and 55. The particular construction of corner blocks 45–48 also establish some significant advantages. First of all, the insulation foam will fill in the voids defined by the honeycomb structure and lock each of the corner blocks 45–48 securely in place. The first and second sets of wing elements 116 and 117 are preferably included to allow each corner block 45–48 to stand off both front panel portion 68 and respective top, bottom and side wall portions 71–74 in order to reduce the amount of plastic touching these portions of outer door pan 35. This arrangement further reduces the potential for the formation of condensate, while also provides the enhanced thermal break as discussed above.

Wing elements 116 and 117 are specifically designed to nest underneath return flange portions 80–83. This feature could be important if any delamination from the foaming were to occur, as corner blocks 45–48 would still retain their respective functions since they are captured by the respective flange portions 80–83. By placing a respective block 45–48 at each corner of interior cavity 100, vertical support brackets 54 and 55 can be made as long as possible and also allows vertical support brackets 54 and 55 to be advantageously fastened close to their respective ends. This enables a reduction in the amount of force on screws 162 and reduces the flexibility of at least front panel portion 68.

Based on the above, it should be readily recognized that the preferred construction for lower freezer door 15 provides a secured attachment arrangement for mating components that ultimately enable freezer door 15 to be interconnected to drawer slides associated with refrigerator 2. The overall construction of freezer door 15 also reduces the potential for increased thermal conduction therethrough, which reduces the possibility of forming condensate in humid environments, and reduces energy required to operate refrigerator 2. In any event, although described with respect to the preferred embodiment of the invention, it should be readily apparent that various changes and/or modifications can be made to the invention without departing from the spirit thereof. In general, the invention is only intended to be limited by the scope of the following claims.

I claim:

1. A method of constructing a freezer door of a refrigerator comprising:

forming an outer door pan by bending a piece of metal to establish a front panel, top, bottom and side wall portions and return flange portions, with an internal cavity being defined within the top, bottom and side wall portions and between the front panel and the return flange portions;

positioning plastic corner brackets within the internal cavity of the outer door pan; and mounting an inner door liner to the outer door pan.

2. The method of claim 1, wherein each of the corner brackets defines a honeycomb structure.

3. The method of claim 1, further comprising: attaching vertical support brackets to the outer door pan through the plurality of corner brackets.

4. The method of claim 3, wherein the vertical support brackets are mechanically secured to the corner brackets with the inner door liner sandwiched there between.

5. The method of claim 4, further comprising: positioning mechanical fasteners interconnecting each vertical support brackets to two of the corner bracket through slots provided in the inner door liner.

6. The method of claim 1, further comprising: affixing a plurality of L-shaped brackets to one of the side wall portions and a respective one of the top or bottom wall portions within the internal cavity.

7. The method of claim 6, wherein each of the corner brackets spans a respective one of the plurality of L-shaped brackets.

8. The method of claim 1, further comprising: arranging the corner brackets such that first and second sets of wing elements provided on each corner bracket directly abut respective ones of the top, bottom and side wall portions.

* * * * *